US010573206B1

(12) United States Patent
Canaphany

(10) Patent No.: US 10,573,206 B1
(45) Date of Patent: Feb. 25, 2020

(54) BORDERLESS ADVERTISING LIGHT BOX

(71) Applicant: Guangzhou BrandStand Display Systems Co. Ltd., Guangzhou (CN)

(72) Inventor: Ralph Canaphany, New South Wales (AU)

( * ) Notice: Subject to any disclaimer, the term of this patent is extended or adjusted under 35 U.S.C. 154(b) by 0 days.

(21) Appl. No.: 16/263,875

(22) Filed: Jan. 31, 2019

(51) Int. Cl.
*G09F 13/04* (2006.01)

(52) U.S. Cl.
CPC ..... *G09F 13/0413* (2013.01); *G09F 13/0404* (2013.01); *G09F 2013/0445* (2013.01); *G09F 2013/0468* (2013.01)

(58) Field of Classification Search
CPC ..... G09F 2013/0445
USPC ..... 40/549
See application file for complete search history.

(56) References Cited

U.S. PATENT DOCUMENTS 3,771,245 A * 11/1973 Mabrey ..... G09F 13/10 40/367
2006/0042141 A1* 3/2006 Hansen ..... E04B 2/7422 40/782
2006/0080874 A1* 4/2006 Eberwein ..... G09F 13/04 40/564
2015/0143729 A1* 5/2015 Pyc ..... G09F 15/0012 40/607.1
2017/0249878 A1* 8/2017 Frey ..... G09G 3/00
2018/0182266 A1* 6/2018 Lim ..... G09F 13/0409

* cited by examiner

*Primary Examiner* — Kristina N Junge
(74) *Attorney, Agent, or Firm* — Braxton Perrone, PLLC; Gregory Perrone; Bobby W. Braxton

(57) ABSTRACT

The present utility model discloses a rimless clipped-cloth advertising light box comprising first drawing cloths, first adhesive bars and first section materials, the first section materials being fixedly connected end to end to form a frame, the first drawing cloths being fixedly connected to both sides of the frame, characterized in that: the first adhesive bars are L-shaped structures with the longer legs thereof slotted into the respective first section materials and projected from the plane of the frame formed by the first section materials, and with the outer sides of the shorter legs thereof flush with the outer sides of the respective first section materials. The perimeters of the first drawing cloths are not directly connected to the first section materials but through the first adhesive bars. This mode of connection enables the illumination to directly shine on the first drawing cloths through the first adhesive bars, thereby making the first drawing cloths to have no dark edges, enabling the complete display of the advertisement content, and achieving better advertising effect and aesthetical pleasantness.

19 Claims, 4 Drawing Sheets

BORDERLESS ADVERTISING LIGHT BOX

This application claims priority to pending Chinese patent application no. 201920096474.9 filed Jan. 21, 2019, incorporated herein by reference in its entirety.

TECHNICAL FIELD

The present utility model relates to the technical field of light boxes and, more particularly, to a clipped-cloth advertisement display device.

BACKGROUND

A clipped-cloth light box is made up of an aluminum section frame, high-brightness LED light bars and UV soft films with advertising pictures spray-painted on the soft films. When installing drawing screen onto a clipped-cloth light box, the adhesive bars already installed around the perimeter of the light box are simply slotted into the grooves in the frame of the light box. Hence its installation is simpler and more convenient than that of stretched-cloth light box. Replacement of its drawing screen can be carried out by pulling out the adhesive bars, which is convenient and fast. The installation of clipped-cloth light boxes can be more flexible. They can be installed both indoor and outdoor by being suspended, hung or erected, and their drawing screens are capable of being conveniently replaced and stored. Therefore, clipped-cloth light boxes are more convenient for places where activities are often conducted. Their brightness can also be adjusted based on different scenes and occasions. Clipped-cloth light boxes can be easily installed and they are primarily used for many indoor and outdoor places such as mobile phone outlets, hairdressing salons, shopping arcades, beauty chain stores, railway stations, car parks, hotels, highway toll stations, banks, photo studios, etc. They can be suspended, hung or erected, and their drawing screens can be easily replaced and stored. Hence, they are more convenient for activity venues.

Some drawing cloths used for clipped-cloth light boxes have anti-ageing characteristics which make their screed effects more durable, better able to display the content and attract attention. The aluminum alloy section materials around their perimeters are secure and anti-rust. The energy efficiency of LED bars used for these light boxes is higher than those of conventional illumination sources by 80%, and these LED bars can be used for a maximum of 100,000 hours. This makes them effective and energy-saving.

However, prior art clipped-cloth light box has the following adequacies:

When used at night, shadows of the first section materials are projected around the perimeters of the first drawing cloths and produce dark rims which result in the complete invisibility of the advertisement contents at the perimeters of the first drawing cloths. This in turn results in poor advertising effect and aesthetical unpleasantness.

SUMMARY OF THE UTILITY MODEL

(1) Technical Problems Resolved

In order to overcome the inadequacy of prior art, the present utility model aims to resolve the problems of the first drawing cloths having dark rims around their perimeters by providing a rimless clipped-cloth advertising light box.

(2) Technical Scheme

To this end, the present utility model provides the following technical scheme: a rimless clipped-cloth advertising light box, comprising first drawing cloths, first adhesive bars and first section materials, the first section materials being fixedly connected end to end to form a frame, the first drawing cloths being fixedly connected to both sides of the frame, characterized in that: the first adhesive bars are L-shaped structures with the longer legs thereof slotted into the respective first section materials and projected from the plane of the frame formed by the first section materials, and with the outer sides of the shorter legs thereof flush with the outer sides of the respective first section materials.

Further, two lights are fixedly connected vertically inside the frame between the top and bottom thereof, the two lights being connected in parallel and connected to a power line.

Further, the bottom of the frame is provided with two footings perpendicularly and fixedly connected with the outside thereof.

Further, the first adhesive bars are either transparent or light-conductive.

Further, the faces of the frame formed by the first section materials are covered by the first drawing cloths.

Further, the first drawing cloths have no dark rims around their perimeters and the illumination from the lights is spread out to the edges of the frame, causing the rimless clipped-cloth advertising light box to have no unlit area.

Further, the outer edges of the frame are provided with grooved channels.

(3) Beneficial Effects

The rimless clipped-cloth advertising light box provided by the present utility model has the following beneficial effects:

The first drawing cloths are projected from the plane of the frame formed by the first section materials and projected from the side perimeter, to cover the frame formed by the first section materials. This mode of connection enables the illumination to directly shine on the first drawing cloths through the first adhesive bars, thereby making the first drawing cloths to have no dark edges. As the perimeters of the first drawing cloths fully cover the frame formed by the first section materials, the frame cannot be seen from the faces. The first drawing cloths are extended to the edges of the light box, thereby enabling the complete display of the advertisement content, and achieving better advertising effect and aesthetical pleasantness.

Figure 1:
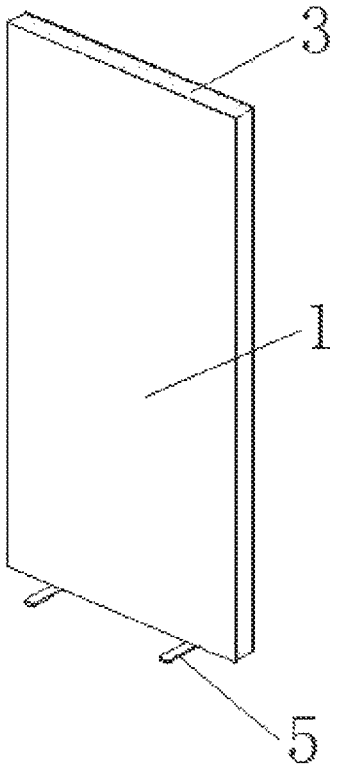
FIG. 1 is an overall structural schematic of the present utility model.
Figure 2:
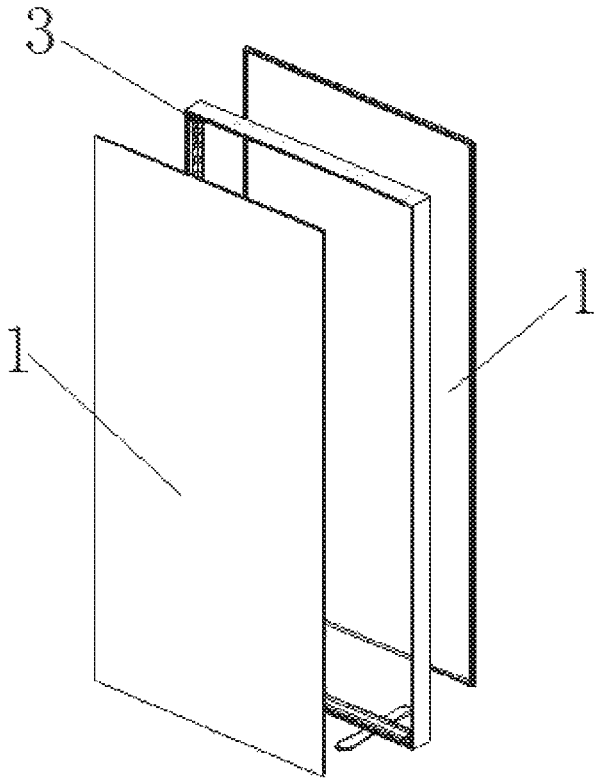
FIG. 2 is an exploded view of the present utility model.
Figure 3:
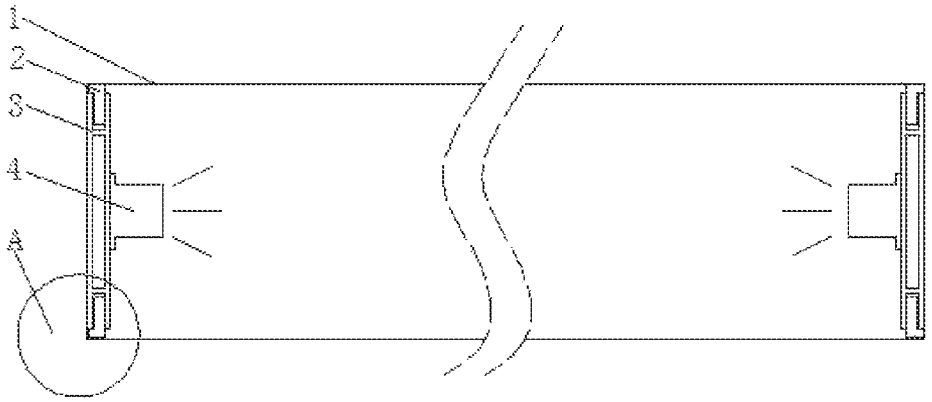
FIG. 3 is a cross-sectional view of the present utility model.
Figure 4:
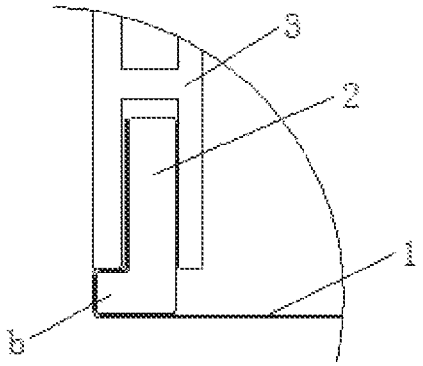
FIG. 4 is a structural schematic illustrating portion A of FIG. 3.
Figure 5:
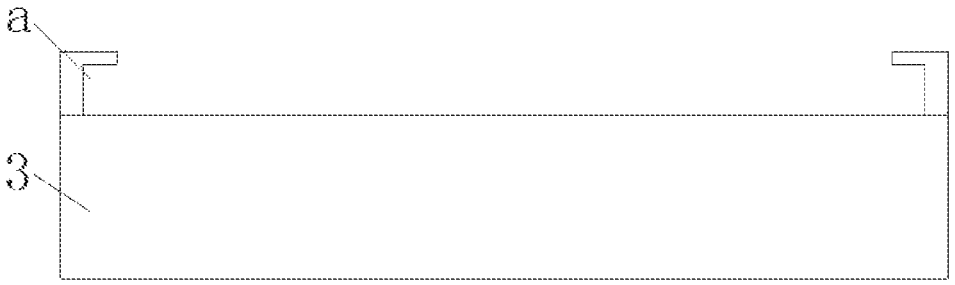
FIG. 5 is a sectional view of a frame formed by the first section materials in the present utility model.

In the figures: 1 denotes first drawing cloth; 2 denotes first adhesive bar; 3 denotes first section material; 4 denotes light; 5 denotes footing; 6 denotes second section material; 7 denotes second adhesive bar; and 8 denotes second drawing cloth.

DETAILED DESCRIPTION

The present utility model is described in further detail below with reference to the accompanying drawings and the technical solutions thereof. It is apparent that the embodiments described are merely some but not all embodiments of the present utility model. Therefore, all other embodiments obtained by persons skilled in the art based on the embodiments hereof without creative labor shall fall within the scope of protection of the present utility model.

With reference to FIGS. 1-4, the present utility model provides a technical scheme as follows: a rimless clipped-cloth advertising light box, comprising first drawing cloths 1, first adhesive bars 2 and first section materials 3, the first section materials 3 being fixedly connected end to end to form a frame, the first drawing cloths 1 being fixedly connected to both sides of the frame, characterized in that: the first adhesive bars 2 are L-shaped structures with the longer legs thereof slotted into the respective first section materials 3 and projected from the plane of the frame formed by the first section materials 3, and with the outer sides of the shorter legs thereof flush with the outer sides of the respective first section materials 3; two lights 4 are fixedly connected vertically inside the frame between the top and bottom thereof, the two lights 4 being connected in parallel and connected to a power line; the bottom of the frame is provided with two footings 5 perpendicularly and fixedly connected with the outside thereof the first adhesive bars 2 are either transparent or light-conductive; the faces of the frame formed by the first section materials 3 are covered by the first drawing cloths 1; the first drawing cloths 1 have no dark rims around their perimeters and the illumination from the lights 4 is spread out to the edges of the frame, causing the rimless clipped-cloth advertising light box to have no unlit area; the outer edges of the frame are provided with grooved channels "a".

Figure 6:
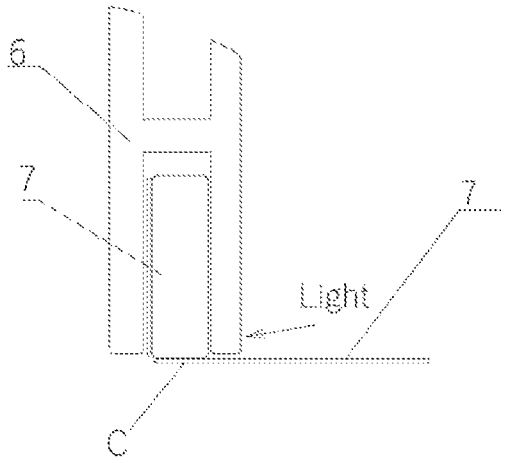
FIG. 6 is a schematic illustrating a prior art rimmed clipped-cloth advertising light box.

Operating Principles:

Power supply is turned on at night. The rimless lipped-cloth advertising light box is fixed at a suitable location by means of the footings 5, and the illumination generated by the lights 4 shines on the respective first drawing cloths 1, enabling the advertisement on the first drawing cloths 1 to be viewed. During this time, the illumination of the lights 4 shines on the perimeters of the respective first drawing cloths 1 through portions "b" of the respective first adhesive bars. In this way, no dark rims are generated around the perimeters of the first drawing cloths 1, and better advertising effect and aesthetical pleasantness are achieved. In the case of prior art technical scheme as shown in FIG. 6, when the illumination shines on the second drawing cloth 8 the inner side of the second drawing cloth 8 is blocked by the second section material 6, and a dark rim is generated at portion "c" of the second drawing cloth 8, thus causing the advertisement content thereon to be invisible.

Also, a drawing cloth with a width equal to that of the frame may be slotted into the grooved channel "a" so that the side of the frame can be made use of, and the drawing cloth has some effect of protection on the frame.

It must be noted that relational terminologies such as "first" and "second" used herein are merely intended to differentiate one entity or operation from another entity or operation, and do not require these entities or operations to have any actual relation or sequence. Also, terms such as "comprise", "include" or other variants are intended to cover non-exclusive inclusion, thereby making processes, methods, articles or equipment that include a series of essential factors not only include those essential factors but also include other essential factors which are not explicitly enumerated, or further include the inherent factors of these processes, methods, articles or equipment.

While the foregoing has illustrated and described preferred embodiments of the present utility model, it will be understood by persons of ordinary skill in the art that variations, alterations, substitutions and modifications may be made to these embodiments without departing from the spirit and principles of the present utility model, and the scope of the present utility model shall be defined by the appended claims and their equivalents.

The invention claimed is:

1. A borderless graphic advertising light box, comprising:
- a first graphic sign having a first edge and a second edge;
- a first L-shaped translucent bar adhered to the first edge of the first graphic sign; and
- a first frame side having a first channel for receiving the first L-shaped translucent bar, and
- wherein a first end of the L-shaped translucent bar is inserted into the first channel and a second end of the L-shaped translucent bar extends outwardly from the first channel to form a corner,
- wherein the first edge of the first graphic sign extends over the corner and light from a light source behind the first graphic sign passes through the first L-shaped translucent bar and illuminates the first edge of the first graphic sign extending over the corner.

2. The borderless graphic advertising light box of claim 1, further comprising:
- a frame upper end and a frame lower end fixedly connected to the light source.

3. The borderless graphic advertising light box of claim 2, wherein the frame lower end is fixedly connected with a bottom foot having two feet vertically aligned with the frame lower end.

4. The borderless graphic advertising light box of claim 1, wherein the first frame side comprises a first profile covered by the first graphic sign.

5. The borderless graphic advertising light box of claim 1, wherein light generated by the light source extends to a first edge of the first frame side.

6. A borderless advertising light box display, comprising:
- a first screen having a first edge and a second edge;
- a first L-shaped translucent bar adhered to the first edge of the first screen; and
- a first frame side having a first channel at a first end of the first frame for receiving the first L-shaped translucent bar adhered to the first edge of the first screen,
- wherein the first L-shaped translucent bar-inserted into the first channel forms a corner,
- wherein the first edge of the first screen wraps around the corner and allows passage of light from a light source in the interior of the advertising light box through the first L-shaped translucent bar and the adhered first edge of the first screen.

7. The borderless advertising light box of claim 6, wherein a long end of the first L-shaped translucent bar—with the first edge of the first screen adhered thereon is slidably inserted into the first channel.

8. The borderless advertising light box of claim 7, wherein a short end of the first L-shaped translucent bar-includes a first exterior edge co-extensive with an exterior edge of the first frame side.

9. The borderless graphic advertising light box of claim 8, wherein the short end of the first L-shaped translucent bar-includes a second exterior edge co-extensive with the first edge of the first screen.

10. The borderless graphic advertising light box of claim 9 further comprising a second channel at a second frame side for fixedly connecting the second edge of the first screen to the second frame side.

11. The borderless graphic advertising light box of claim 10, further comprising a second L-shaped translucent bar.

12. The borderless graphic advertising light box of claim 11, wherein the second L-shaped translucent bar-comprises a long end slidably insertable into the second channel.

13. The borderless graphic advertising light box of claim 12, wherein a short end of the second L-shaped translucent bar includes a first exterior edge co-extensive with an exterior edge of the second frame side.

14. The borderless graphic advertising light box of claim 13, wherein the short end of the second L-shaped translucent bar includes a second exterior edge co-extensive with the second edge of the first screen.

15. The borderless graphic advertising light box of claim 10, wherein the light source is fixedly connected approximate to a first end of the first frame side between the first screen and a second screen.

16. The borderless graphic advertising light box of claim 11, wherein a second light source is fixedly connected approximate to a second end of the first frame side between the first screen and the second screen.

17. The borderless silicon edge graphic advertising light box of claim 12, wherein at least one foot is situated approximate to the second end of the first frame side.

18. The borderless edge graphic advertising light box of claim 6, wherein the corner comprises a substantially squared corner.

19. The borderless edge graphic advertising light box of claim 6, wherein the corner comprises a rounded corner.

* * * * *